US005345294A

United States Patent [19]

Nomura et al.

[11] Patent Number: 5,345,294

[45] Date of Patent: Sep. 6, 1994

[54] PROCESS CARTRIDGE AND IMAGE FORMING APPARATUS USING SAME

[75] Inventors: Yoshiya Nomura, Tokyo; Tadayuki Tsuda; Isao Ikemoto, both of Kawasaki; Kazushi Watanabe, Yokohama; Kazuhiko Ishiwata; Makoto Tanaka, both of Tokyo; Kanji Yano, Kawasaki; Shinichi Sasaki, Fujisawa, all of Japan

[73] Assignee: Canon Kabushiki Kaisha, Tokyo, Japan

[21] Appl. No.: 48,962

[22] Filed: Dec. 22, 1992

Related U.S. Application Data

[63] Continuation of Ser. No. 727,126, Jul. 9, 1991, abandoned.

[30] Foreign Application Priority Data

Jul. 13, 1990 [JP] Japan ..... 2-184094

[51] Int. Cl.[5] ..... G03G 15/00

[52] U.S. Cl. ..... 355/200; 355/210; 355/211

[58] Field of Search ..... 355/219; 361/225

[56] References Cited

U.S. PATENT DOCUMENTS

| | | | |
|---|---|---|---|
| 4,165,169 | 8/1979 | Miyashita et al. | 355/211 |
| 4,607,936 | 8/1986 | Miyakawa et al. | 355/210 |
| 4,714,337 | 12/1987 | Nishino et al. | 355/200 |
| 4,814,248 | 3/1989 | Kamata et al. | 355/211 X |
| 4,839,690 | 6/1989 | Onoda | 355/211 |
| 5,023,660 | 6/1991 | Ebata et al. | 355/200 |
| 5,028,966 | 7/1991 | Kozuka et al. | 355/211 X |
| 5,053,817 | 10/1991 | Ogiri et al. | 355/211 |
| 5,095,335 | 3/1992 | Watanabe et al. | 355/210 |
| 5,128,715 | 7/1992 | Furuyama et al. | 355/200 |
| 5,130,751 | 7/1992 | Sato et al. | 355/211 |
| 5,196,889 | 3/1993 | Ronnenberg et al. | 355/219 X |
| 5,210,574 | 5/1993 | Kita | 355/211 |

FOREIGN PATENT DOCUMENTS

| | | | |
|---|---|---|---|
| 0130562 | 5/1990 | Japan | 355/211 |

*Primary Examiner*—Matthew S. Smith

*Attorney, Agent, or Firm*—Fitzpatrick, Cella, Harper & Scinto

[57] ABSTRACT

A process cartridge detachably mountable to a main assembly of an image forming apparatus, includes a plurality of process device including at least one member having an electrically conductive cylinder; a supporting frame for supporting as a unit the plural process devices; and an electrode, in the supporting frame, having a first portion electrically contactable to the main assembly and a second portion press-contacted to an end surface of the cylindrical member.

32 Claims, 4 Drawing Sheets

PROCESS CARTRIDGE AND IMAGE FORMING APPARATUS USING SAME

This application is a continuation of application Ser. No. 07/727,126 filed Jul. 9, 1991 now abandoned.

FIELD OF THE INVENTION AND RELATED ART

The present invention relates to an image forming apparatus such as an electrophotographic copying apparatus, an electrostatic recording apparatus or a laser beam printer and to a process cartridge detachably mountable to such an image forming apparatus.

It is known that an image forming apparatus is loaded with a process cartridge which contains an image bearing member, a charging device, a developing device, and a cleaning device supported on a common frame as a unit. The process cartridge is detachably mountable to the main assembly of the image forming apparatus, so that the maintenance and servicing operations are made easier.

When the process cartridge is set in the main assembly of the image forming apparatus, electric connections are to be established between the process cartridge and the main assembly so as to electrically ground the image bearing member in the form of a photosensitive drum and so as to supply developing bias voltage to a developer (toner) carrying member in the form of a developing sleeve.

Referring first to FIGS. 5, 6, 7 and 8, there are shown the grounding mechanism for the photosensitive drum (FIGS. 5 and 6) and an electric connection of the developing sleeve (FIGS. 7 and 8), in exemplary structures.

As shown in FIGS. 5 and 6, the photosensitive drum 10 comprises a base member in the form of a conductive cylinder and a photoconductive layer thereon. A longitudinal end thereof is provided with a flange 104 which supports the photosensitive drum 10 on a supporting shaft 103 and which has an integral gear (made of resin material) for driving the drum 10. A conductive metal grounding plate in the form of a leaf spring is mounted to the gear flange 104. The grounding plate 8 has pawls 8*a* and 8*b* at its outside portion, and the pawls 8*a* and 8*b* are press-contacted to the internal peripheral surface of the photosensitive drum 10. By doing so, the electric connection of the drum 10 is established. In the middle portion of the grounding plate 8, a contact portion 8*c* is formed. The contact portion 8*c* is contacted to an end surface of the supporting shaft 103 for the photosensitive drum 10 by the resiliency of the grounding plate 8 itself. The supporting shaft 103 is disposed in the cartridge and is made of conductive material. When the process cartridge is positioned in place in the main assembly of the image forming apparatus, the supporting shaft 103 is contacted to the contact portion (not shown) of the main assembly of the image forming apparatus.

As shown in FIGS. 7 and 8, a bias plate 210 is disposed in the developing sleeve 112. The bias plate 210 has outer pawls 210*a*, 210*b*, 210*c* and 210*d*, which contact the internal surface of the developing sleeve 112, so that it is fixed therein with the electric connection established with the developing sleeve 112. The bias plate 210 has arms 210*e* and 210*f*, which are contacted to an electrode plate 211 mounted in the housing 14*a* of the process cartridge. The electrode plate 211, similarly to the grounding contact for the photosensitive drum 10, is contacted to a developing bias contact (not shown) of the main assembly of the image forming apparatus so that it is supplied with a bias voltage from an unshown developing bias supply device in the main assembly, when the process cartridge is positioned in place in the main assembly of the image forming apparatus.

However, in the conventional examples, when the gear flange 104 having the grounding plate 8 is bonded to the photosensitive drum 10, it is liable for the bonding material flows to the contact portion of the grounding plate 8 to disturb the electric contact. Therefore, the quantity of the bonding agent and the drying conditions or the like must be strictly controlled.

On the other hand, the size of the process cartridge must generally be small, and in order to meet this demand, the diameter of the photosensitive drum 10 must be small. This prevents increase of the pressing force at the contact portion 8*c* of the grounding plate 8. As a result, the contact of the contact portion 8*c* with the supporting shaft 103 becomes destabalized. If the photosensitive drum 10 is moved in the housing 14*a* in the thrust direction by the distance corresponding to the clearance between the housing 14*a* and the photosensitive drum 10 upon the driving of the photosensitive drum 10, the pressing force between the grounding plate 8 and the supporting shaft 103 changes with the result of destabalized contact therebetween.

With respect to the developing sleeve 112, in order to maintain a constant pressing force between the electrode plate 211 and the arms 210*e* and 210*f* of the bias plate 210, the position of the bias plate 210 from the end of the developing sleeve 112 is required to be highly accurate during the assembling. Similarly to the case of the photosensitive drum 10, when the developing sleeve 112 is moved in the thrust direction by the distance corresponding to the clearance from the housing 14*a*, the contact between the bias plate 210 and the electrode plate 211 is easily destabalized. Furthermore, by the sliding resistance due to the contact between the electrode plate 211 and the arms 210*e* and 210*f* of the bias plate 210, the engagement between the developing sleeve 112 and the pawls 210*a*, 210*b*, 210*c* and 210*d* of the bias plate 210, becomes weaker, with the result that the bias plate 210 does possibly not rotate integrally with the developing sleeve 112. If this occurs, the relative sliding between the bias plate 210 and the developing sleeve 112 produces electric noise, and therefore, the main assembly of the image forming apparatus operates improperly.

SUMMARY OF THE INVENTION

Accordingly, it is a principal object of the present invention to provide a process cartridge and an image forming apparatus usable therewith wherein the electric connection between an image bearing member in the process cartridge and the main assembly of the image forming apparatus is assured.

It is another object of the present invention to provide a process cartridge and an image forming apparatus usable therewith wherein an electric connection between a developer carrying member in the process cartridge and the main assembly of the image bearing member is assured.

According to an embodiment of the present invention, there is provided a process cartridge detachably mountable to a main assembly of an image forming apparatus, comprising: a plurality of process means including at least one member having an electrically conductive cylinder; supporting means for supporting as a unit said plural process means; and an electrode, in said supporting means, having a first portion electrically contactable to the main assembly and a second portion press-contacted to an end surface of said cylindrical member.

Then, the size of process cartridge and/or the image forming apparatus can be reduced. In addition, the positional accuracy is improved by normally urging a constituent element of the process means in one direction.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

The preferred embodiments of the present invention will be described in conjunction with the accompanying drawings.

Figure 4:
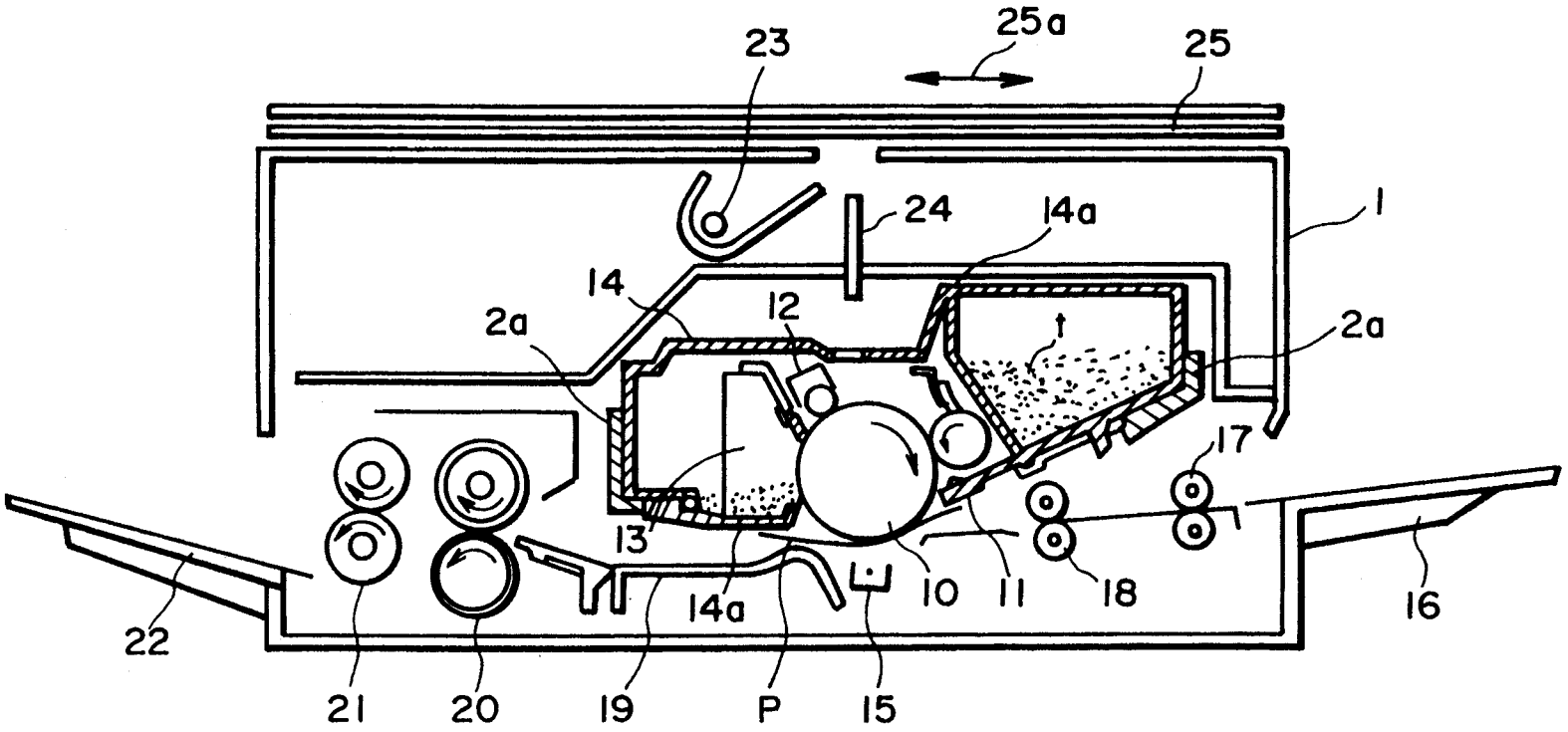
FIG. 4 is a sectional view of an image forming apparatus.

Referring to FIG. 4, there is shown an image forming apparatus in the form of an electrophotographic copying apparatus. It comprises a photosensitive drum 10 (image bearing member) which comprises a photoconductive layer and a conductive cylindrical member supporting the photoconductive layer. Around the photosensitive drum 10, there are provided a developing device 11, a charger 12, a cleaning device 13 and other process means actable on the photosensitive drum 10 for image formation. The photosensitive drum 10 and these process means are supported as a unit on a frame of a process cartridge casing 14*a*, so that a process cartridge 14 detachable from a main assembly 1 of the image forming apparatus, is constituted.

Below the photosensitive drum 10, there is a transfer charger 15. At a sheet feeding side of the transfer charger 15, there are disposed a sheet feeding tray 16, a sheet feeding roller 17 and a registration rollers 18. At the sheet discharge side thereof, there are a sheet guide 19, an image fixing device 20, a sheet discharging roller 21 and a sheet discharging tray 22.

Above the process cartridge 14 in the main assembly of the image forming apparatus, there are an illumination lamp 23 for illuminating the original and a short focus optical element array 24 for projecting on the photosensitive drum 10 the light from the illumination lamp 23 and reflected by an original. At an upper position of the main assembly 1, an original carriage 25 reciprocable in the directions indicated by an arrow 25*a* is provided.

In operation, the photosensitive drum 10 is uniformly charged by a charger 12 and is exposed to light image of the original on the original carriage 25 by the illumination lamp 23 and through the short focus optical element array 24, so that an electrostatic latent image is formed on the photosensitive drum 10. The electrostatic latent image is carried on the photosensitive drum 10 to the developing device 11, where the latent image receives toner t by the developing device 11 and is visualized into a toner image. A transfer sheet P is supplied from the sheet supply tray 16 by the sheet feeding roller 17 to the registration roller 18. The registration roller 18 further feeds the transfer material P to between the photosensitive drum 10 and the transfer charger 15 in timed relation with the image on the photosensitive drum 10. Then, the toner image is transferred from the photosensitive drum 10 onto the transfer sheet P. The transfer sheet P now carrying the toner image is fed into the fixing device 20, where the toner image is fixed into a permanent image. Then, the transfer sheet P is discharged onto a discharge tray 22 by the discharging rollers 21. After the completion of the image transfer operation, the photosensitive drum 10 is cleaned by the cleaning device 13 so that the residual toner thereon is removed so as to be prepared for the next image forming operation.

Figure 1:
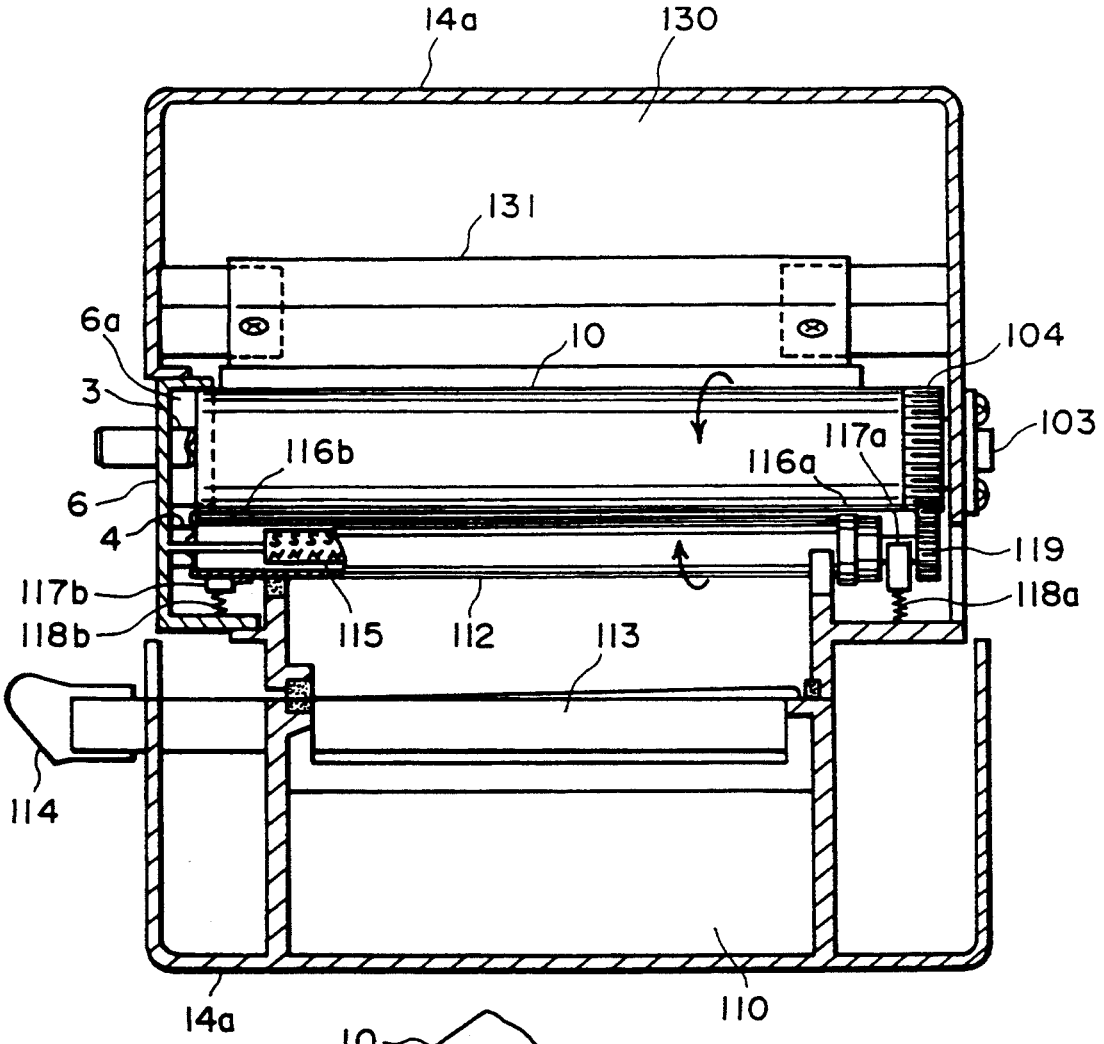
FIG. 1 is a top plan view in cross-section of a process cartridge according to an embodiment of the present invention.
Figure 2:
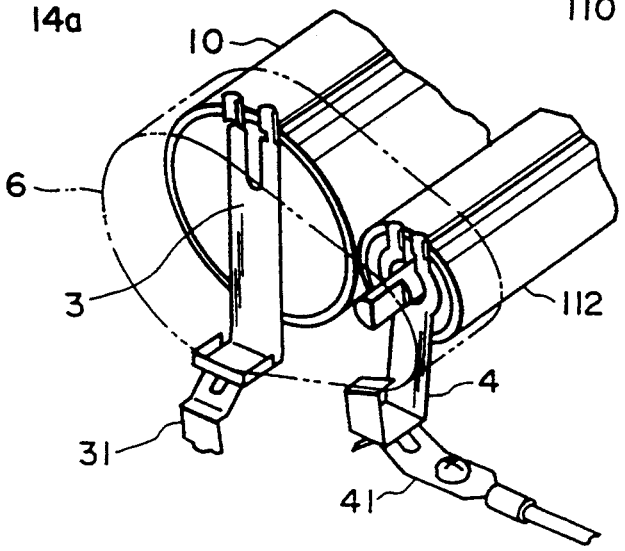
FIG. 2 is a perspective view of a major part of the process cartridge.

Referring to FIGS. 1 and 2, the description will be made as to the process cartridge according to an embodiment of the present invention which has a photosensitive drum and a developing sleeve for carrying toner.

As shown in the Figures, the photosensitive drum 10 is in the form of a cylinder and is made of aluminum, stainless steel or brass. To a longitudinal end of the photosensitive drum 10, a flange 104 made of resin material and having an integral gear is mounted. The gear engages a driving gear mounted in the main assembly (not shown) of the image forming apparatus to receive a driving force, so that it is rotated in the direction indicated by an arrow at a predetermined rotational speed. It is rotatably supported on a rotational shaft 103 mounted to a part of the casing 14*a* of the process cartridge.

The other end of the photosensitive drum 10 is rotatably supported by a bearing 6*a* which partly encloses the peripheral surface of the drum 10 with the aid of a holder 6.

In the developing sleeve 112 in the form of a cylinder and made of aluminum alloy or stainless steel, there is a magnet roller 115, and the developing sleeve 112 is rotatably supported by bearings 117*a* and 117*b*. The gear 119 at the end is normally meshed with the photosensitive drum, so that the photosensitive drum is rotated.

The bearings 117*a* and 117*b* supporting the longitudinal end of the sleeve 112 are provided with compression springs 118*a* and 118*b* to normally urge the developing sleeve 112 toward the photosensitive drum 10. The developing sleeve 112 is provided with spacer rings 116*a* and 116*b*, each of the rings extending around the entire circumference, so as to maintain a constant clearance between the photosensitive drum 10 and the surface of the developing sleeve 112.

On the side wall surface of the holder 6, a grounding electrode plate (grounding plate) 3 made of metal such as phosphor bronze or spring stainless steel and a voltage applying electrode (bias plate) 4, are mounted. End portions of the plates 3 and 4 are in sliding press-contact with longitudinal end surfaces of the photosensitive drum 10 and the developing sleeve 112. A clearance is deliberately provided in the thrust direction for the photosensitive drum 10 and for the developing sleeve 112 so as to permit smooth rotation thereof and for the purpose of permitting manufacturing tolerances. The clearances, however, may make the thrust direction positions of the photosensitive drum 10 and the developing sleeve 112 destabalized. In this embodiment, however, the grounding plate 3 and the bias plate 4 urges the photosensitive drum 10 and the developing sleeve 112 in one thrust direction so as to prevent the movement thereof in the thrust direction, so that the rotations thereof are stabilized.

Additionally, reference numeral 114 designates a pull tab for pulling out a toner seal 113.

Figure 3:
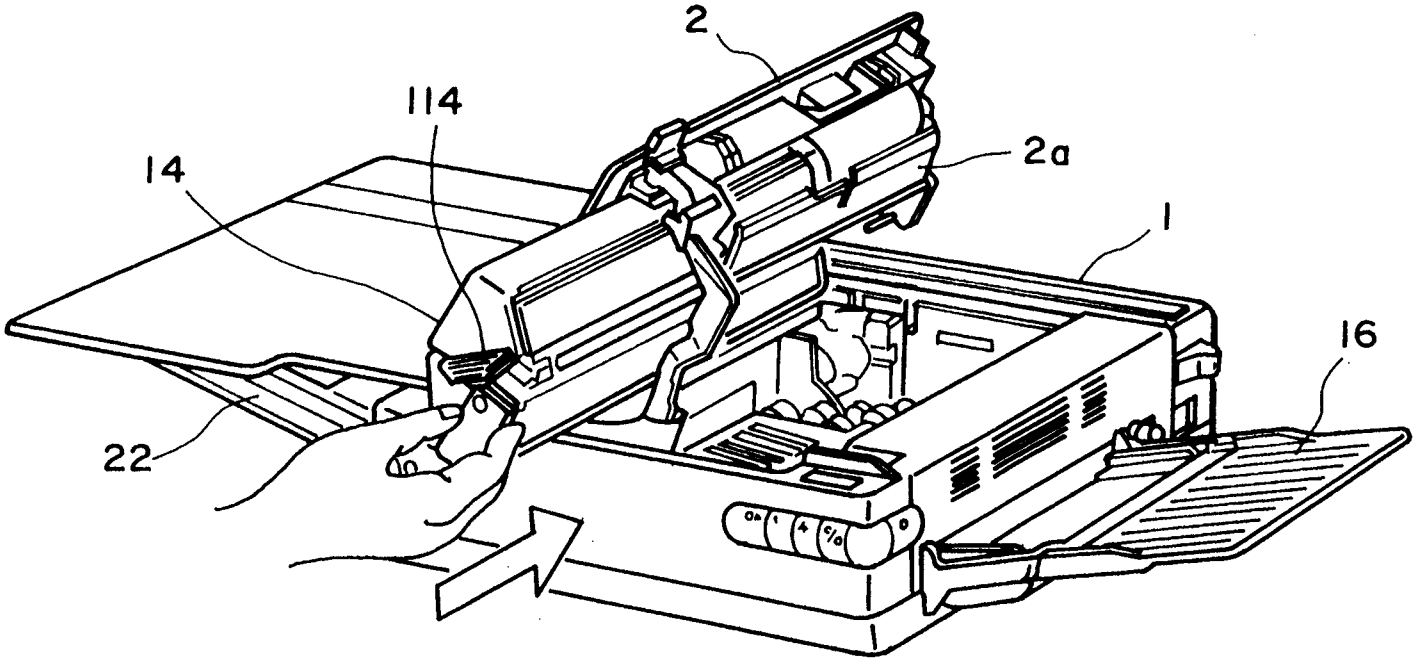
FIG. 3 is a perspective view illustrating mounting of the process cartridge in the image forming apparatus.

As shown in FIG. 3, the process cartridge 14 is mounted in the direction indicated by an arrow to a top cover 2 of the main assembly of the image forming apparatus. The process cartridge 14 is pushed along guides 2*a* to the correct position, and thereafter, the top cover 2 is closed. As shown in FIG. 2, when the process cartridge 14 is mounted in the main assembly 1 of the image forming apparatus, the grounding plate 3 and the bias plate 4 are press-contacted to an elastic grounding electrode 31 and bias electrode 41 fixedly mounted in the main assembly 1 of the image forming apparatus, so that the electric contacts are established therebetween, respectively.

Figure 5:
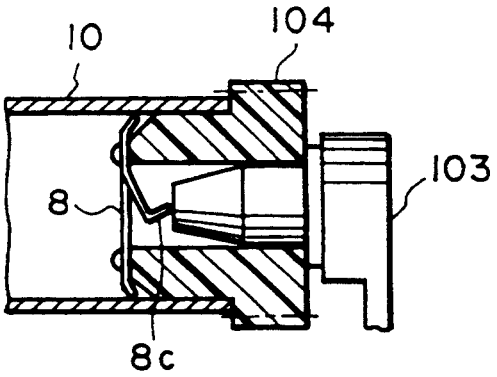
FIG. 5 PRIOR ART
FIGS. 5 and 6 are a sectional view and a perspective view illustrating an example of a photosensitive drum grounding structure.
Figure 6:
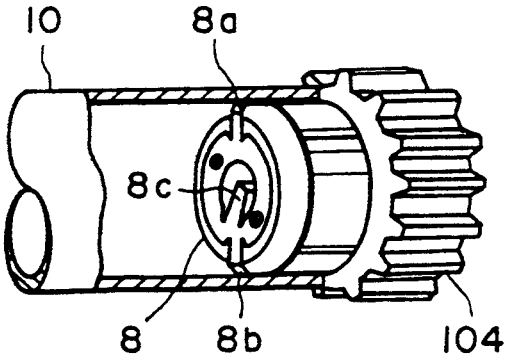
FIG. 6 PRIOR ART

With the above-described structure, the grounding plate 3 functioning as a grounding electrode for the photosensitive drum 10 is directly press-contacted to an end surface of the photosensitive drum 10, and therefore, the conventional necessity for the drum flange 104, the grounding plate 8 and the supporting shaft 103 or the like (FIGS. 5 and 6), is eliminated, so that the number of parts is reduced. Since the drum flange is not used, the bonding of the flange to the drum is not required. Therefore, the problem unstable electric contact due to the bonding material having flown into between the grounding plate 3 and the photosensitive drum 10), can be eliminated, by which the reliability of the apparatus is improved.

Additionally, the length and width of the spring contact portion of the grounding plate 3 can be increased irrespective of the size of the photosensitive drum 10, and therefore, the pressing force can be increased. Therefore, the contact between the contact portion and the photosensitive drum 10 is assured, while permitting reduction of the diameter of the photosensitive drum 10.

Figure 7:
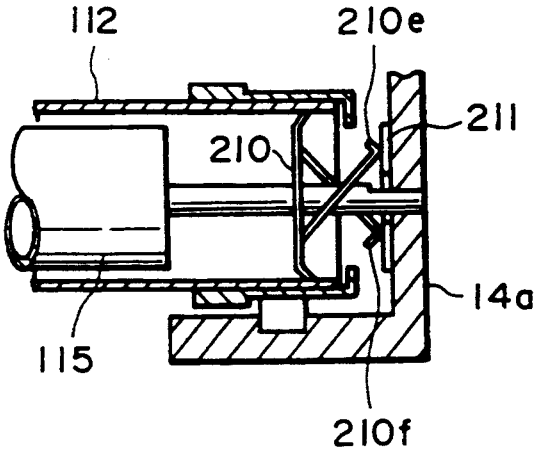
FIG. 7 PRIOR ART
FIGS. 7 and 8 are a sectional view and a perspective view illustrating an electric connection structure for a developing sleeve.
Figure 8:
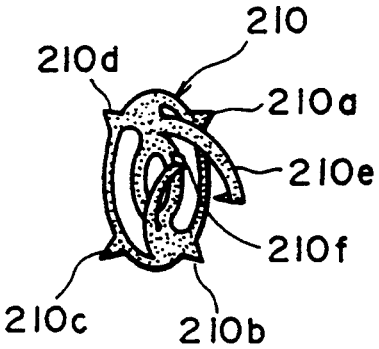
FIG. 8 PRIOR ART

In the developing sleeve 112, the bias plate 4 is directly press-contacted to the end surface of the developing sleeve 112. The conventional necessity for the bias plate 210 (FIGS. 7 and 8) in the developing sleeve 112, is eliminated so that the number of parts can be reduced and the highly accurate assembling step can be eliminated.

Similarly to the case of the photosensitive drum 10, the length and width of the spring contact portion of the bias plate 4 can be selected irrespective of the diameter of the developing sleeve 112, and therefore, the pressing force at the contact portion can be increased. Since the developing sleeve 112 is normally urged in the thrust direction by the bias plate 4, and therefore, the stabilized contact therebetween can be accomplished. This is preferable from the standpoint of reduction of the developing sleeve diameter.

In addition, no bias plate is provided in the developing sleeve 112, and therefore, the conventional inconveniences (the electric noise produced by failure in the fixing between the pawls of the bias plate and the developing sleeve 112) can be eliminated. This also improves the reliability of the apparatus.

In the foregoing embodiments, the photosensitive drum 10 has a diameter of 24 mm and a thickness of 0.5 mm and is made of aluminum. The developing sleeve 112 has a diameter of 12 mm and a thickness of 0.5 mm and is made of aluminum. The electrodes 3 and 4 are made of phosphor bronze and are press-contacted with the force of 70–250 g (preferably 150–200 g). The pressing force can be determined properly by one skilled in the art by consideration of the degree of deflection, free length elastically deformable, width of the electrode, elasticity coefficient of the material.

The process cartridge may contain the photosensitive drum and the sleeve as a unit, or may contain as a unit the cleaning device and the photosensitive drum, or may contain as a unit the charger, the cleaning device and the photosensitive drum, or may contain as a unit the charger and the developing device.

The photosensitive member contained in the cartridge may be in the form of the drum or an electrophotographic photosensitive belt supported on plural conductive cylindrical members.

As described in the foregoing, according to the present invention, the photosensitive member or the sleeve contained in the process cartridge is urged in the thrust direction by an electrode press-contacted to a longitudinal end surface thereof, and therefore, the position of the photosensitive member and/or the sleeve in the cartridge when the cartridge is mounted in the main assembly of the image forming apparatus, is stabilized, and in addition, the electric contact therebetween can be assured.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to a main assembly of an image forming apparatus, comprising:

a plurality of process means including at least one electrically conductive cylindrical member having an open end, wherein an electrically conductive portion is exposed at a substantially circular longitudinal end of the open end;

supporting means for supporting as a unit said plurality of process means; and an electrode, in said supporting means, comprising a first portion electrically contactable to the main assembly and a second portion press-contacted to said longitudinal end of said electrically conductive cylindrical member.

2. A process cartridge according to claim 1, wherein said cylindrical member is a photosensitive member having an electrophotographic photosensitive layer.

3. A process cartridge according to claim 1, wherein said cylindrical member is a sleeve for supporting toner.

4. A process cartridge according to claim 1, wherein said process cartridge comprises at least two cylindrical members including a photosensitive member having an electrophotographic photosensitive layer and a sleeve member for carrying toner.

5. A process cartridge according to claim 1, wherein said electrode is in the form of a leaf spring.

6. A process cartridge detachably mountable to a main assembly of an image forming apparatus, comprising:

an electrically conductive cylindrical member supporting an electrophotographic photosensitive layer;

process means actable on said photosensitive member for formation of an image;

supporting means for supporting as a unit said electrically conductive cylindrical member and said process means; and an electrode, in said supporting means, comprising a first portion electrically contactable to the main assembly and a second portion press-contacted to a longitudinal end surface, substantially circular in shape, of said cylindrical member, wherein said cylindrical member has a drive transmission means for receiving a driving force from the main assembly, and said electrode is disposed at an end remote from said drive transmission means.

7. A process cartridge detachably mountable to a main assembly of an image forming apparatus, comprising:

an electrically conductive cylindrical member supporting an electrophotographic photosensitive layer;

developing means for developing a latent image formed on the photosensitive layer, said developing means including a cylindrical member for carrying toner;

supporting means for supporting as a unit said electrically conductive cylindrical member and said developing means; and an electrode for each of said cylindrical members, in said supporting means, comprising a first portion electrically contactable to the main assembly and a second portion press-contacted to a longitudinal end surface substantially circular in shape of an associated one of said cylindrical members.

8. A process cartridge according to claim 7, wherein said electrodes are disposed adjacent the same side of said process cartridge.

9. A process cartridge according to claim 7, wherein each of said cylindrical members has drive transmission means, and said electrodes are disposed adjacent the sides remote from said drive transmission means.

10. A process cartridge according to claim 7, wherein said cylindrical member of said developing means receives driving force from drive transmission means for said electrically conductive cylindrical member having the photosensitive layer.

11. A process cartridge according to claim 7, wherein the first portion of said electrode electrically contacts the main assembly when said process cartridge is mounted in the main assembly.

12. A process cartridge according to claim 7, wherein said electrically conductive cylindrical member is made of aluminum and is hollow.

13. A process cartridge according to claim 7, wherein said electrode is made of phosphor bronze.

14. A process cartridge according to claim 7, wherein said electrode is resilient and urges said longitudinal end surface with total force in the range of 70–250 g.

15. A process cartridge according to claim 14, wherein the total force is in the range of 150–200 g.

16. An image forming apparatus comprising:

a process cartridge, detachably mountable to a main assembly of said image forming apparatus, comprising a plurality of process means including at least one electrically conductive cylindrical member having an open end, wherein an electrically conductive portion is exposed at a substantially circular longitudinal end of the open end;

supporting means for supporting as a unit, said plurality of process means; an electrode, in said supporting means, comprising a first portion electrically contactable to the main assembly and a second portion press-contacted to said longitudinal end of said electrically conductive cylindrical member;

guiding means for guiding said process cartridge to a predetermined position; and a main assembly electrode contactable to said electrode of said process cartridge when said process cartridge is at the predetermined position.

17. An image forming apparatus according to claim 16, wherein said electrically conductive cylindrical member is a photosensitive member having an electrophotographic photosensitive layer.

18. An image forming apparatus according to claim 16, wherein said electrically cylindrical member is a sleeve for supporting toner.

19. An image forming apparatus usable with a process cartridge detachably mountable hereto, a process cartridge detachably mountable to a main assembly of an image forming apparatus comprising an electrically conductive cylindrical member supporting an electrophotographic photosensitive layer; developing means for developing a latent image formed on the photosensitive layer, said developing means including a cylindrical member for carrying toner; supporting means for supporting as a unit said electrically conductive cylindrical member and said developing means; and an electrode for each of said cylindrical members in said supporting means, each of said electrodes comprising a first portion electrically contactable to the main assembly and a second portion press-contacted to a longitudinal end surface substantially circular in shape of an associated one of said cylindrical members;

guiding means for guiding said process cartridge to a predetermined position;

an electrode of the main assembly contactable with each of said electrodes of said process cartridge when said process cartridge is at the predetermined position; and drive transmission means for driving said electrically conductive cylindrical member having the photosensitive layer.

20. A process cartridge according to claim 19, wherein the first portion of said electrode electrically contacts the main assembly when said process cartridge is mounted in the main assembly.

21. A process cartridge according to claim 19, wherein said electrically conductive cylindrical member is made of aluminum and is hollow.

22. A process cartridge according to claim 19, wherein said electrode is made of phosphor bronze.

23. A process cartridge according to claim 19, wherein said electrode is resilient and urges said longitudinal end surface with total force in the range of 70–250 g.

24. A process cartridge according to claim 23, wherein the total force is in the range of 150–200 g.

25. A process cartridge detachably mountable to a main assembly of an image forming apparatus, comprising:

a plurality of process means including at least one electrically conductive cylindrical member;

supporting means for supporting, as a unit, said plurality of process means; and an electrode, in said supporting means, comprising a first portion electrically contactable to the main assembly and a second portion press-contacted to a longitudinal end surface, substantially circular in shape, of said electrically conductive cylindrical member wherein said electrode directly contacts the longitudinal end surface and is connectable with a bias voltage surface.

26. A process cartridge detachably mountable to a main assembly of an image forming apparatus, comprising:

a plurality of process means including at least one electrically conductive cylindrical member;

supporting means for supporting, as a unit, said plurality of process means; and an electrode, in said supporting means, comprising a first portion electrically contactable to the main assembly and a second portion press-contacted to a longitudinal end surface, substantially circular in shape, of said electrically conductive cylindrical member, wherein said electrode comprises a bias voltage applying electrode and is electrically connected with a bias voltage application electrode of the main assembly when said process cartridge is mounted in the main assembly.

27. A process cartridge detachably mountable to a main assembly of an image forming apparatus, comprising:

a plurality of process means including at least one electrically conductive cylindrical member;

supporting means for supporting, as a unit, said plurality of process means; and an electrode, in said supporting means, comprising a first portion electrically contactable to the main assembly and a second portion press-contacted to a longitudinal end surface, substantially circular in shape, of said electrically conductive cylindrical member, wherein said electrode is resilient and urges said longitudinal end surface with total force in the range of 70–250 g.

28. A process cartridge according to claim 27, wherein the total force is in the range of 150–200 g.

29. A process cartridge detachably mountable to a main assembly of an image forming apparatus, comprising:

an electrically conductive cylindrical member supporting an electrophotographic photosensitive layer;

process means actable on said photosensitive member for formation of an image;

supporting means for supporting, as a unit, said cylindrical member and said process means; and an electrode, in said supporting means, comprising a first portion electrically contactable to the main assembly and a second portion press-contacted to a longitudinal end surface, substantially circular in shape, of said cylindrical member, wherein said electrode is resilient and urges said longitudinal end surface with total force in the range of 70–250 g.

30. A process cartridge according to claim 29, wherein the total force is in the range of 150–200 g.

31. An image forming apparatus comprising:

a process cartridge, detachably mountable to a main assembly of the image forming apparatus, comprising a plurality of process means including at least one electrically conductive cylindrical member; supporting means for supporting, as a unit, said plurality of process means; an electrode, in said supporting means, comprising a first portion electrically contactable to the main assembly and a second portion press-contacted to a longitudinal end surface, substantially circular in shape, of said cylindrical member;

guiding means for guiding said process cartridge to a predetermined position; and a main assembly electrode contactable to said electrode of said process cartridge when said process cartridge is at the predetermined position, wherein said electrode is resilient and urges said longitudinal end surface with total force in the range of 70–250 g.

32. A process cartridge according to claim 31, wherein the total force is in the range of 150–200 g.

* * * * *

UNITED STATES PATENT AND TRADEMARK OFFICE

CERTIFICATE OF CORRECTION

PATENT NO. : 5,345,294

DATED : September 6, 1994

INVENTOR(S) : Yoshiya Nomura, et al.

It is certified that error appears in the above-indentified patent and that said Letters Patent is hereby corrected as shown below:

On Title page :

Line 4, "device" should read --devices--.

COLUMN 2:

Line 11, "flows" should read --to flow--.
Line 21, "destabalized" should read --destabilized--.
Line 28, "destabalized" should read --destabilized--.
Line 34, "accurate" should read --arcuate--.
Line 39, "destabalized" should read --destabilized--.
Line 45, "does possibly" should read --possibly does--.

COLUMN 5:

Line 11, "destabalized" should read --destabilized--.
Line 13, "urges" should read --urge--.
Line 41, "unstable" should read --(unstable--.
Line 42, "flown" should read --flowed--.
Line 67, "and therefore," should be deleted.

COLUMN 6:

Line 18, "electrode" should read --electrode, and--.

UNITED STATES PATENT AND TRADEMARK OFFICE

CERTIFICATE OF CORRECTION

PATENT NO. : 5,345,294 Page 2 of 2

DATED : September 6, 1994

INVENTOR(S) : Yoshiya Nomura, et al.

It is certified that error appears in the above-indentified patent and that said Letters Patent is hereby corrected as shown below:

COLUMN 8:

Line 27, "electrically" should read --electrically conductive--.

Line 30, "hereto" should read --thereto--.

COLUMN 9:

Line 15, "member" should read --member,--.

Signed and Sealed this

Thirteenth Day of June, 1995

*Attest:*

*Attesting Officer*

BRUCE LEHMAN

*Commissioner of Patents and Trademarks*